US006378650B2

(12) United States Patent
Mauthner

(10) Patent No.: US 6,378,650 B2
(45) Date of Patent: Apr. 30, 2002

(54) FORCE LIMITING ROPE BRAKE

(75) Inventor: Kirk Martin Mauthner, Invermere (CA)

(73) Assignee: Basecamp Innovations, Ltd., Invermere (CA)

( * ) Notice: Subject to any disclaimer, the term of this patent is extended or adjusted under 35 U.S.C. 154(b) by 0 days.

(21) Appl. No.: 09/778,722

(22) Filed: Feb. 8, 2001

Related U.S. Application Data

(60) Provisional application No. 60/181,096, filed on Feb. 8, 2000.

(51) Int. Cl.[7] ..... A47L 3/04; A62B 1/20

(52) U.S. Cl. ..... 182/5; 182/193; 188/65.5

(58) Field of Search ..... 182/5, 72, 193, 182/192, 191; 254/389, 390, 391, 405; 188/65.4, 65.5, 65.2

(56) References Cited

U.S. PATENT DOCUMENTS

| | | | | | |
|---|---|---|---|---|---|
| 394,109 | A | * | 12/1888 | Fowler | 188/65.3 |
| 524,481 | A | * | 8/1894 | Fowler | 182/193 |
| 561,733 | A | * | 6/1896 | Stacy | 182/193 |
| 916,091 | A | * | 3/1909 | Batzer | 254/391 X |
| 1,616,924 | A | | 2/1927 | Ratzer | |
| 4,830,340 | A | * | 5/1989 | Knitig | 254/391 |
| 5,054,577 | A | * | 10/1991 | Petzl et al. | 182/5 |
| 5,577,576 | A | * | 11/1996 | Petzl et al. | 188/65.4 |
| 5,799,753 | A | | 9/1998 | Peltier | |
| 5,850,893 | A | * | 12/1998 | Hede et al. | 182/193 |
| 5,975,243 | A | * | 11/1999 | Lorbeck | 182/193 |
| 6,029,777 | A | * | 2/2000 | Rogelja | 182/193 |

FOREIGN PATENT DOCUMENTS

| | | |
|---|---|---|
| DE | 24 39 678 | 3/1976 |
| FR | 2 623 411 | 5/1989 |

* cited by examiner

*Primary Examiner*—Daniel P. Stodola
*Assistant Examiner*—Hugh B. Thompson
(74) *Attorney, Agent, or Firm*—Antony C. Edwards

(57) ABSTRACT

A force limiting rope brake includes a pair of rigid first and second side-plates in parallel overlaid array sandwiching therebetween a pivotally mounted pulley. The pulley pivots about a pivot axis extending orthogonally between first and second side-plates. A pair of rigid wedges are rigidly mounted between the first and second side-plates on opposite lateral sides of the pulley. The first and second wedges and the pulley when in the first and second positions define, respectively, first and second gaps, the first and second gaps identical in size and sized so that rope segments journalled through the first and second gaps are compressed in either the first or second gaps when the pulley is rotated into either the first or second positions respectively.

20 Claims, 6 Drawing Sheets

FORCE LIMITING ROPE BRAKE

CROSS REFERENCE TO RELATED APPLICATION

This application claims priority from U.S. Provisional Patent Application No. 60/181,096 filed Feb. 8, 2000 titled Force Limiting Rope Brake.

FIELD OF THE INVENTION

This invention relates to the field of rope braking devices generally, and, in particular, devices for use in applications where it is desirable to force-limit a tensioned rope such as in rescue belay devices used in rope rescue operations, in industrial, commercial and film rigging, in industrial fall protection, in rope access, and in boating and sailing.

BACKGROUND OF THE INVENTION

In rope rescue, a separate un-tensioned back-up, often called a belay system, is commonly used to catch a falling load in the unlikely event that any component in the primary, or mainline system should fail. As yet, there are no regulatory standards of performance for the device used to "catch" the falling rescue load. In the mid-eighties, a proposal was put forth to the Province of British Columbia's Provincial Emergency Program (PEP) by the British Columbia Council of Technical Rescue (BCCTR), who at that time provided recommendations on rope rescue matters to PEP, that a rescue belay be capable of catching a 200 kg mass representing two people, plus equipment, falling one metre on three metres of 11 mm rope, with no more than one metre additional travel distance (pre-rebound) and with no more than 15 kN of peak force. The National Fire Protection Association (NFPA) has adopted a larger 272 kg mass (600 pounds) to represent a two person load, though they have not yet specified any belay competence criteria.

The NFPA is the only standard setting body at this time which considers a two person load to be 272 kg and it is largely their standards (NFPA 1983, 1995 edition) which have led to a widespread North American use of 12.7 mm kernmantle construction ropes for use in rope rescue within the fire service and industrial rescue. Outside of North America more conventionally a rescue-sized load is considered to be about 200 kg and kernmantle rope diameters of 11 mm are common. Much of the North American, British and Australian rope rescue community has loosely agreed that a relative worst case fall of a rescue sized load is a one metre drop of that load with only three metres of rope in service. However, this has yet to put into writing as a standard. These worst-case criteria represent a mainline system failure during the critical phase of backing a load over a vertical edge, leaving the belay system to catch the falling load. Because the NFPA chose a large mass to represent a two person load and rope diameter for their standards, developing a mechanical belay device that can meet the "informal" relative worst-case belay competence criteria has been difficult.

To date, the only system that has met, i.e. be "reliable", to the BCCTR standard is the Tandem Prusik Belay (2, 3-wrap, 8 mm nylon kernmantle cord Prusik hitches in tandem on the belay rope, connected to a load releasing hitch, which is then connected to an anchor). This technique is considered to be too cumbersome and difficult to learn by many. Until now, no mechanical belay device has proven to be reliable enough to warrant its use. While some mechanical device designs have been attempted, they have all resulted in one or more serious shortcomings. For example, they require too much human gripping ability, cut the rope, they cannot release the load post-drop, etc. Conventional mechanical rope grabs, which are usually intended for ascending a rope, or catching a single person load, have also been tried for rescue belays, but with little success.

Also, many rope grabs, designed for ascending, tend to work well in one direction only, that is, taking rope in or letting rope out, but not both. In the prior art, see for example U.S. Pat. Nos. 5,850,893, 5,054,577, 4,596,314, 5,597,052, 5,076,400, 5,975,243, 5,360,083 and 5,577,576. In rescue belaying, however, the belay device should allow for easy feed in both directions. It would also be advantageous if the belay device were bi-directional, meaning that the load could be attached to either end of the rope exiting the belay device, and it would still work. This would help reduce the risk of human error when loading the rope into the device.

Another challenge has been to find a rescue belay device that can work well for a range of rope diameters, and not be limited to just one brand of rope. Typical kernmantle construction rescue ropes, have properties (e.g. stiffness, actual vs. nominal diameter, braid technique, elongation, etc.) that vary considerably between manufacturers. Variations in rope properties exist because of differing beliefs among users and manufacturers between which properties are most important for rope rescue. Some of these properties have diametrically opposing needs. A rope-brand specific device has limited value as rope rescue groups and agencies may have little control over which brand of rope is bought, other than it must pass a certain standard, like NFPA 1983.

SUMMARY OF THE INVENTION

The device of the present invention:

a) is usable on a wide range of nylon or polyester kernmantle construction rope diameters (e.g. 10.0–11.5 mm for 200 kg mass and 11.5–13.0 mm for 280 kg mass).

b) can catch the relative worst case fall of a rescue-sized load:
   i) the minimum BCCTR belay competence drop test criteria of a 2 person, 200 kg mass falling 1 m onto 3 m of 11.1 mm rope with no more than 1 m additional travel distance (pre-rebound) and no more than 15 kN peak force;
   ii) similar to above but with a 280 kg mass (representing an NFPA sized load) falling 1 m onto 3 m of 12.7 mm rope, again with a target of no more than 1 m additional travel and with no more than 15 kN peak force;

c) after a fall-arrest, the load can be lowered with control by use of a manually operable release lever;

d) has bi-directional action, i.e. the load can be on either rope-end exiting the belay device thereby minimizing the risk of human error when loading the rope into the device;

e) self-locks during a shock force, and for a "slow" fall-like tumble, it requires some (up to 30 N) belayer, i.e. human, gripping ability to trigger fall arrest if the smallest diameter, most supple rope was used. With stiffer, large diameter ropes, even a tumble will likely trigger fall arrest;

f) works on dry, wet, muddy and icy ropes, although any solidly frozen rope will be very difficult to handle;

g) is relatively light (approximately 650 grams);

h) is easy to load the rope;

i) is durable (can withstand rough handling);

j) exceeds the NFPA 1983–1995 edition Auxiliary Equipment minimum 3-sigma static breaking strength of 36.0 kN;

k) can easily feed the rope through the device for belaying and also provides that the tension in the rope is releasable for example by manually selectable unlocking of the self-locking brake mechanism as described above.

In summary, the force limiting rope brake device of the present invention includes a pair of rigid first and second side-plates in parallel overlaid array sandwiching therebetween a pivotally mounted pulley. The pulley pivots about a pivot axis extending orthogonally between parallel first and second planes, the first and second planes containing first ends of the first and second side-plates.

The pulley is elongate, for example oval or obround, when viewed in cross-section parallel to the first and second planes. The pulley is pivotally mounted at a first end of the pulley so that the pivoting of the pulley rotates an opposite second end of the pulley in an arc between the side-plates about the pivot axis. The arc sweeps out an arcuate path parallel to the first and second planes and centered relative to the first and second side-plates.

The arcuate path is bounded at its ends by stops. The stops may engage a rigid follower, mounted to the pulley, sliding along a channel or arcuate aperture in the first side-plate. The stops constrain rotation of the pulley about the pivot axis between fully rotated first and second positions symmetrically and oppositely disposed on opposite sides of a center plane bisecting the first and second side-plates and orthogonal to the first and second planes.

A pair of rigid wedges are rigidly mounted between the first and second side-plates on opposite lateral sides of the pulley. The first and second wedges and the pulley when in the first and second positions define, respectively, first and second gaps, the first and second gaps identical in size and sized so that rope segments journalled through the first and second gaps are compressed in either the first or second gaps when the pulley is rotated into either the first or second positions respectively.

The pulley is sized to receive 1½ wraps of the rope around a smooth, advantageously non-finished, rope engaging surface of the pulley parallel to the wedges. Further advantageously the wraps of rope are separated by wrap-separating means such as oppositely extending pins mounted to the rope engaging surface of the pulley. Further still, the wedges on their rope engaging surfaces, may be striated perpendicularly to the first and second planes such as by a parallel array of grooves.

The force limiting rope brake device of the present invention may also be described as including a pivotally mounted elongate pulley mounted to a base. The pulley pivots about a pivot axis extending orthogonally from the base.

The pulley is pivotally mounted at a first end of the pulley so that the pivoting of the pulley rotates an opposite second end of the pulley in an arc about the pivot axis. The arc sweeps out an arcuate path generally parallel to the base.

The arcuate path is bounded at its ends by stops. The stops may engage a rigid follower, mounted to the pulley, sliding along a channel or arcuate aperture in the first side-plate. The stops constrain rotation of the pulley about the pivot axis between fully rotated first and second positions symmetrically and oppositely disposed on opposite sides of a center plane bisecting the arc and orthogonal to the base.

A pair of rigid wedges are rigidly mounted to the base on opposite lateral sides of the pulley. The first and second wedges and the pulley when in the first and second positions define, respectively, first and second gaps, the first and second gaps identical in size and sized so that rope segments journalled through the first and second gaps are compressed in either the first or second gaps when the pulley is rotated into either the first or second positions respectively.

The pulley is sized to receive one and one half wraps of the rope around a smooth, rope engaging surface of the pulley parallel to the wedges. Further, the wraps of rope may be separated by a wrap-separating means such as oppositely extending pins mounted to the rope engaging surface of the pulley. Further still, the wedges on their rope engaging surfaces, may be striated perpendicularly to the first and second planes such as by a parallel array of grooves.

The base may have an arcuate aperture therein. A rigid follower is mounted to the pulley so as to slide in the arcuate aperture. Ends of the aperture at the ends of the arcuate path form the stops.

A cam lever may be pivotally mounted to the follower so as to dispose a cam on one end of the cam lever on an opposite side of the follower, opposite to a handle on the cam lever. The cam engages rigid members on the base upon rotation of the handle to thereby urge rotation of the pulley about the pivot axis and to thereby release the rope when clamped between one of the wedges and the pulley.

A rope retainer may be mounted to the pulley, opposite to the base, so as to retain on the pulley a rope wound onto the pulley during translation of the rope through the pulley. The base may be a first plate. The retainer may be a second plate. The first and second plates may be generally parallel and the pulley pivotally mounted so as to be sandwiched therebetween.

DETAILED DESCRIPTION OF EMBODIMENTS OF THE INVENTION

Figure 1:
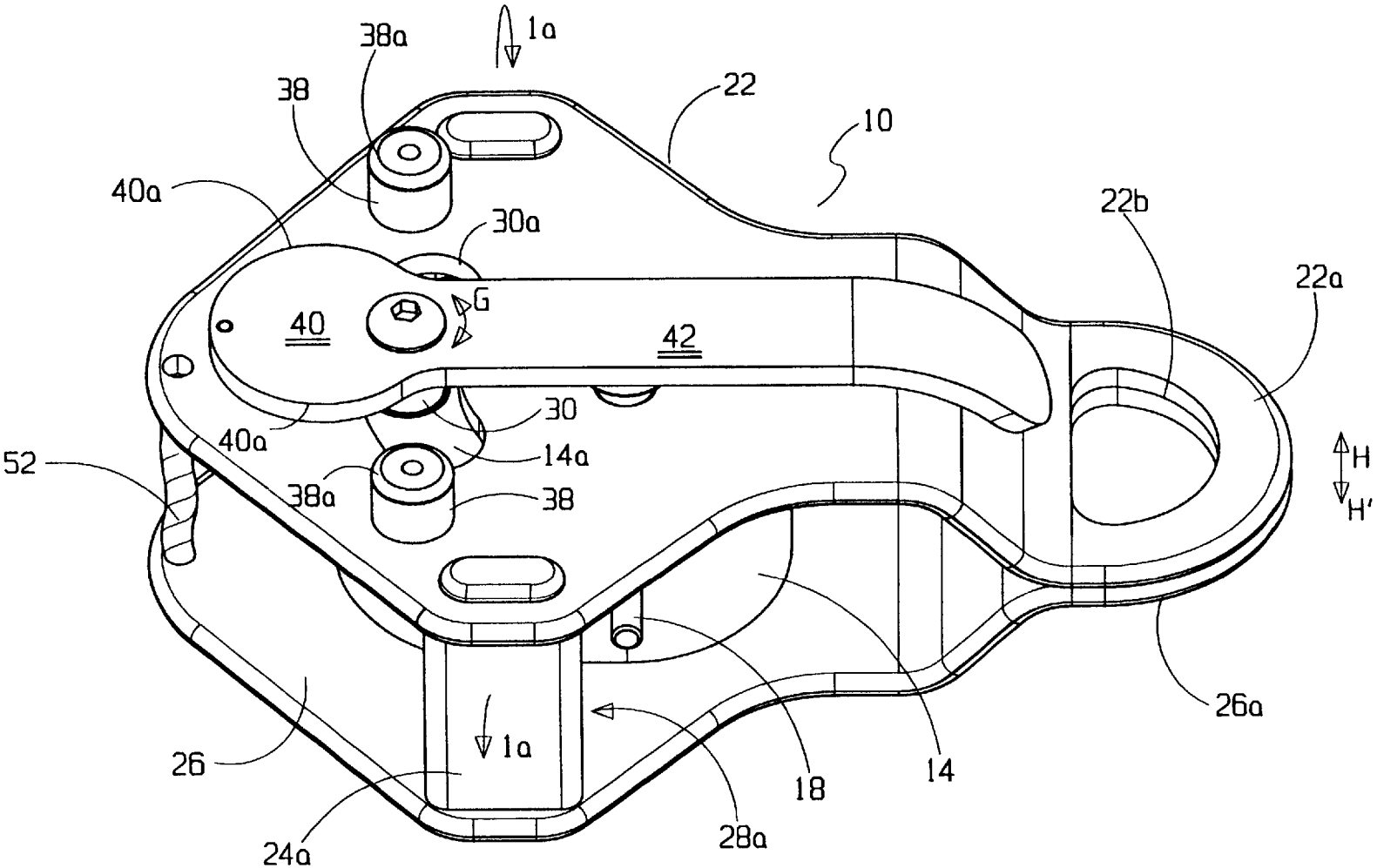
FIG. 1 is, in perspective view, the rescue belay device of the present invention.
Figure 1A:
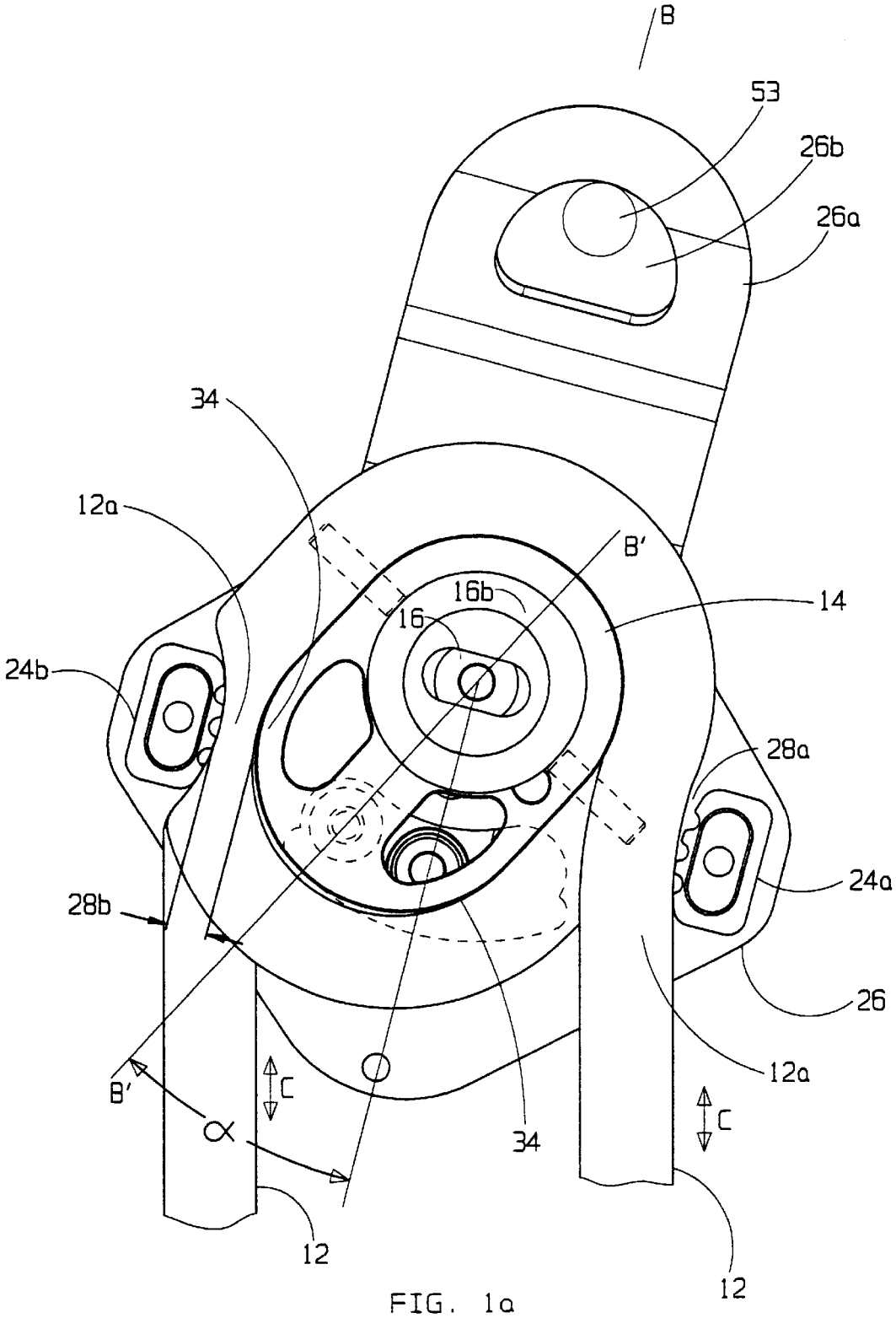
FIG. 1*a* is a sectional view along section line 1*a*—1*a* in FIG. 1, showing a rope segment being compressed between a wedge and the pulley.
Figure 2:
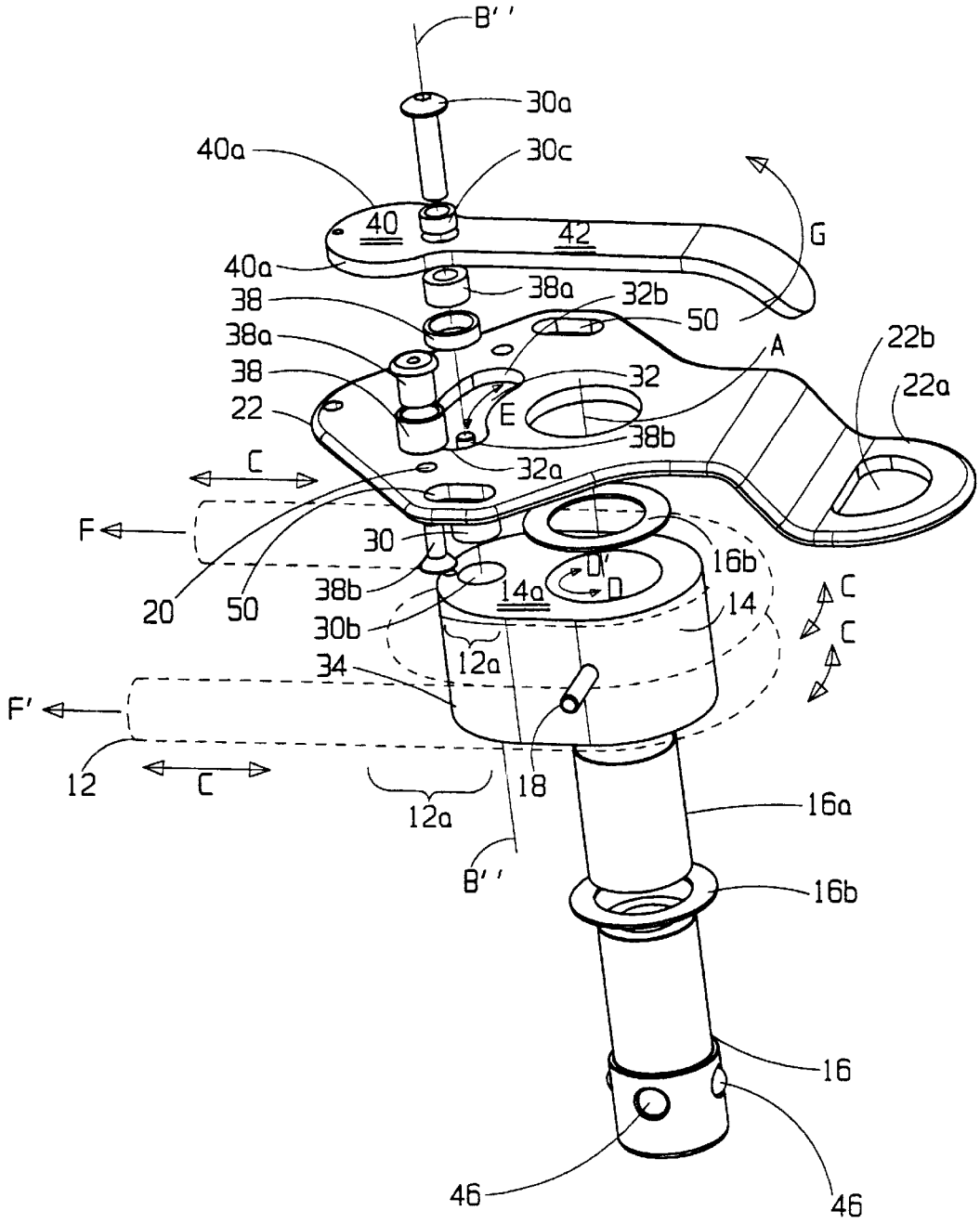
FIG. 2 is, in exploded view, one side-plate and the internal pulley mounting mechanism and release lever of the device of FIG. 1.
Figure 3:
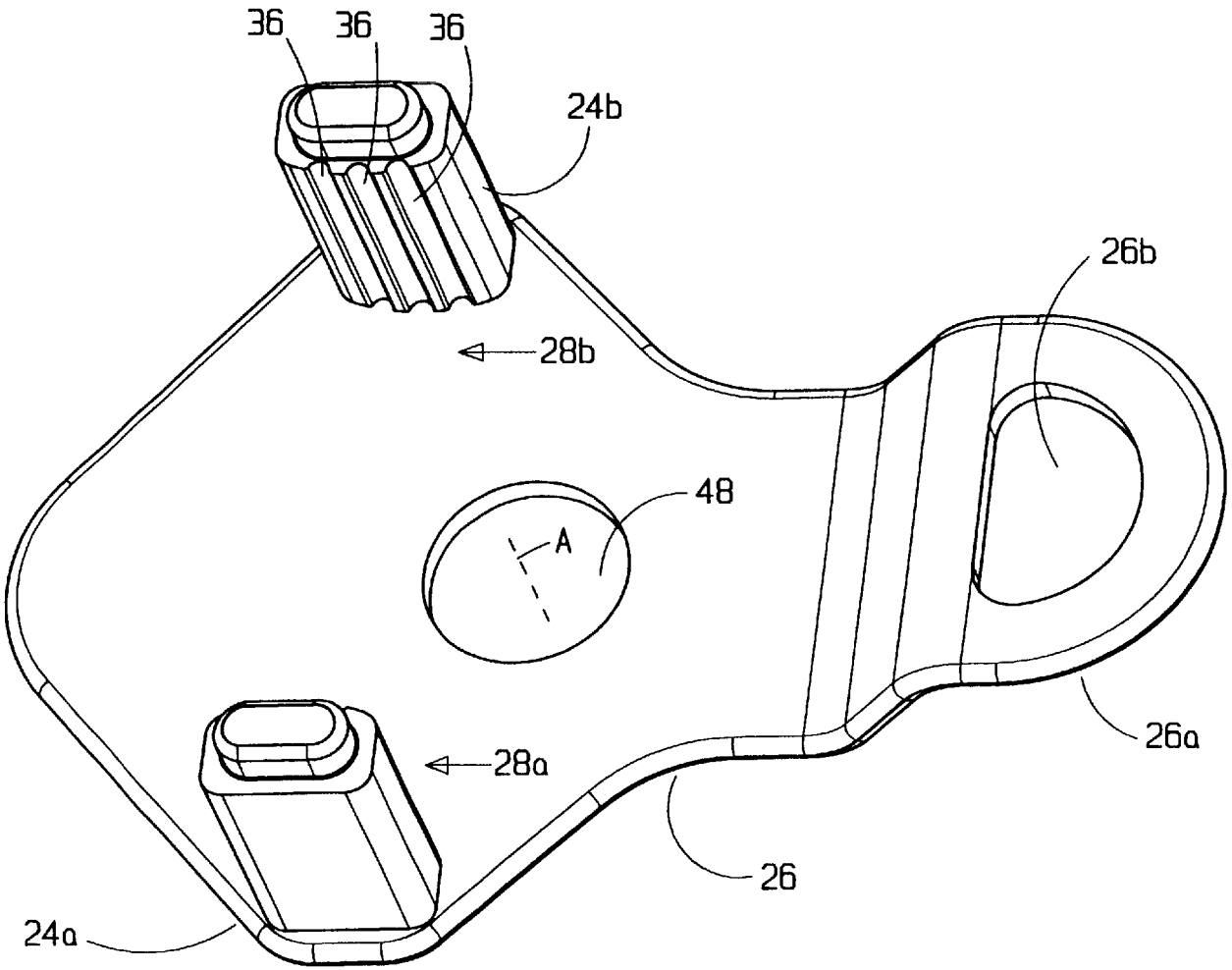
FIG. 3 is, in perspective view, the opposite side-plate from that of FIG. 2 and the stationary wedges of the rescue belay device of FIG. 1.
Figure 4:
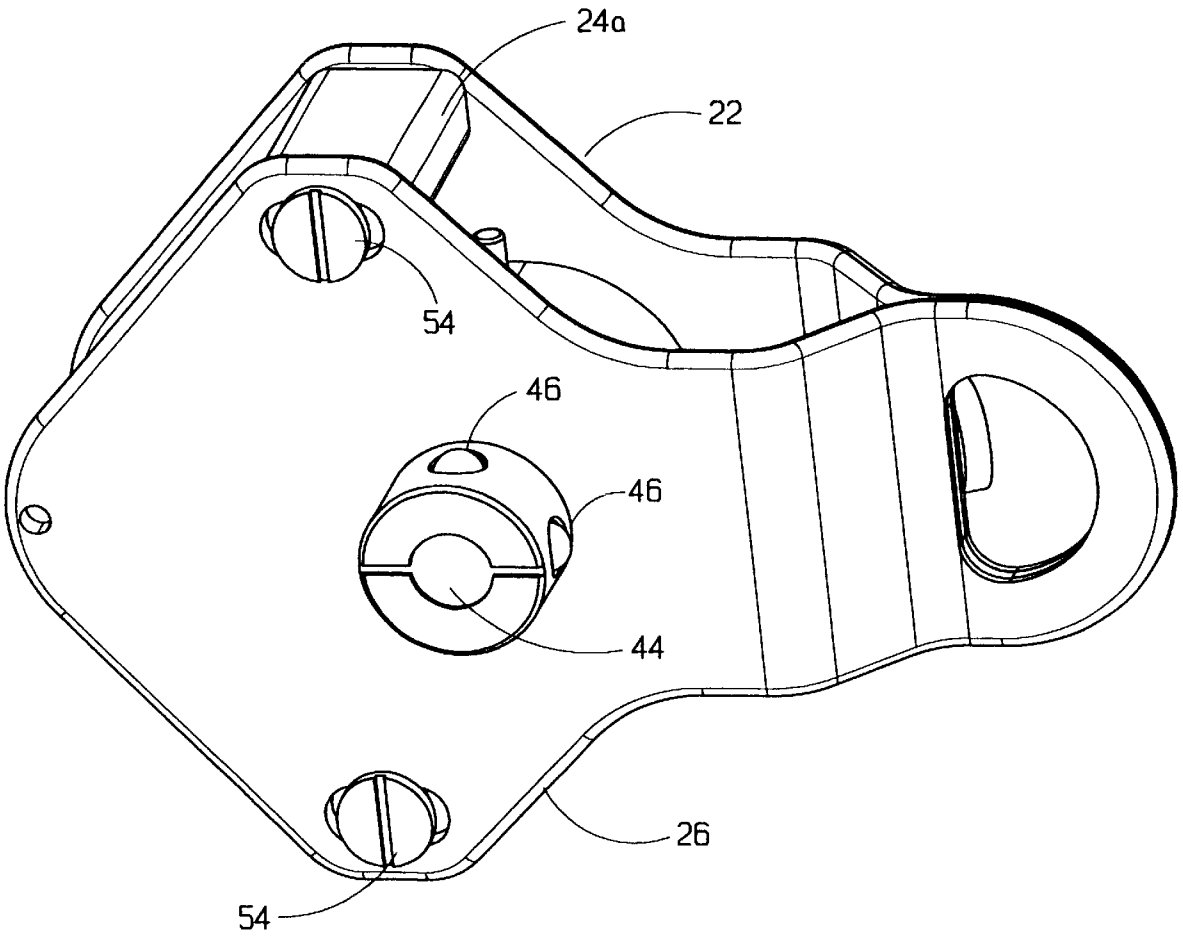
FIG. 4 is a lower perspective view of the device of FIG. 1.

It is desired in the present invention to provide a belay device which:

a) is usable on a range of nylon or polyester kernmantle rope brands and diameters (e.g. 10.0–11.5 mm for 200 kg mass, and 11.5–13.0 mm for 280 kg mass);

b) must be able to successfully catch, i.e., arrest a falling rescue load, e.g.:

i) a 200 kg mass as per BCCTR drop test criteria of 2 person load (one metre drop on three metres of 11.1 mm low stretch kernmantle construction rope, less than 15 kN peak force and less than one metre of additional travel, pre-rebound); or, ii) a 272 kg mass and 12.5 mm low stretch kernmantle construction rope as per NFPA standards using similar BCCTR drop test criteria;

c) after a fall-arrest, may release tension and lower the load with control;

d) is bi-directional, allowing either rope and exiting the device to be used as the load rope thereby reducing risk of inadvertent release;

e) self-locks with sudden falls;

f) works on dry, wet, muddy and icy ropes;

g) is as light as possible (i.e. no more than 0.65 kg, preferably lighter);

h) is easy to put on and take off any part of the rope;

i) is durable (capable of withstanding rough handling);

j) has a minimum (i.e. 3-sigma) static breaking strength of 36.0 kN as per NFPA 1983–1995 edition; and, k) allows for hand feeding rope back and forth through the device as per belaying technique.

As may be appreciated upon a review of FIGS. 1–4 by those skilled in the art in the use of the belay device 10, a belay rope 12 (shown in Figure la and in dotted outline in FIG. 2) is wrapped 1½ times around a pivotally mounted smooth oval pulley 14. Pulley 14 is pivotally mounted about pivot axis A on pivot axle 16. Pulley 14 has rope guides to divide the wraps of the rope. The rope guides may be a pair of oppositely disposed rigid pins 18. A spring-mounted ball bearing 20 on surface 14*a* of pulley 14 resiliently engages a corresponding ball detent (not shown) on first side-plate 22. The ball detent is centered on the plate so as to keep pulley 14 centered in a neutral position equi-distant between a pair of opposed facing rigid wedges numbered for reference 24*a* and 24*b*. Wedges 24*a* and 24*b* are rigidly mounted to second side-plate 26, and are positioned a preset distance apart on opposite sides of longitudinal axis B of plate 26. Thus, with pulley 14 in the neutral or centered position, the gaps 28*a* and 28*b* between, respectively, wedges 24*a* and 24*b* and pulley 14 allow free sliding passage of rope 12 in direction C around the pulley and through the gaps.

In a rescue operation a weight, such as a rescuer and patient, are attached to one end of rope 12. If a fall occurs, rope 12 and consequently device 10 receive a shock force. The rope friction around pulley 14 overcomes the detent resistance of ball bearing 20 and causes pulley 14 to rotate around axle 16. A shock force F applied to rope 12 causes rotation of pulley 14 in direction D. A shock force F' causes rotation of pulley 14 in direction D'.

A travel limiter member 30 projects from pulley 14. Member 30 is slidably journalled in aperture 32 in side-plate 22. The ends 32*a* and 32*b* of aperture 32 limit the sliding travel in direction E of member 30 and hence rotational travel of pulley 14 about pivot axis A. The travel is limited so as to leave gaps 28*a* and 28*b* a predetermined size. The lobe 34 on either side of pulley 14 which is rotated closest to its corresponding wedge 24*a* or 24*b* compresses rope segments 12*a* sandwiched between that lobe and the corresponding stationary wedge. The combined effect of 1½ wraps of rope friction around pulley 14 and the "controlled" compression in the gap of the rope segment as a result of the predetermined gap size results in fall arrest. In one embodiment, the pulley surface over which the rope slides is smooth uncoated aluminum. It has been found that a coated surface (i.e. anodized) and slightly irregular surface results in significant rope glazing during fall arrest.

Of importance is the geometry of the oval shape of pulley 14, its presentation angle to the wedges, and the travel limited distance between the pulley lobes and the wedges (the size of the gap). The rope guides on the pulley allow for a smooth, controlled feed. This combination of attributes allow, as seen in Tables 1 and 2, for the force to quickly build, but then limit the peak force to a target value below 15 kN until the energy in the system is dissipated to allow for complete fall arrest with no more than 1 metre of additional travel (taking into account rope stretch, knots tightening up, and any rope slippage through the device). For high energy drops, such as a 280 kg mass falling 1 m onto 3 m of rope, the force/time curve approximates a "flat-topped" wave form, which essentially means the force is being limited until the energy is dissipated.

Of the several pulley designs that were tried, a smooth oval or obround pulley 14 yields the best results. Such a pulley geometry allows for ease of feed of rope 12 in and out of the device for a wide range of rope diameters, conditions and stiffness. Yet because the rope bends and unbends 3 times each in 1½ wraps, the pulley design provides enough efficiency loss (defined as output force divided by input force) to trigger and initiate fall arrest. A round pulley design also allowed for ease of feed, but because it only bent and unbent the rope once each in 1½ wraps, it did not provide enough efficiency loss to trigger the fall arrest action. A square lobed, oval pulley design had too much efficiency loss and triggered too easily and made rope feed difficult and cumbersome. The smoothness of the oval pulley allows the rope to slide over a surface which limits rope glazing and results in no visible rope damage during a fall arrest. The distance between pivot axis A and the pulley perimeter surface provides the appropriate level of torque (moment) to allow for pivoting, i.e. self-locking. In the present embodiment this distance may be between approximately 1.75 inches at the point of furthest separation (i.e. along the longitudinal axis of the pulley) and approximately 1.0 inches at the point of minimum separation (for example along a lateral axis through the pivot axis). This pulley may be approximately 2.75 inches in length along its longitudinal axis.

The oval or obround pulley requires 1½ wraps, which results in two rope segments being simultaneously compressed in the gap between the pulley lobe and the engaged wedge. Compression of two rope segments 12*a* allows accepting a wide range of the available rope diameters (e.g. 10.0–11.5 mm for 200 kg mass, and 11.5–13.0 mm for 280 kg mass). The oval or obround pulley design allows for bi-directionality. Either end of the rope can be used for the load end, i.e. the end pulled out, thereby reducing the risk of a user improperly rigging the rope in the device. From a manufacturing standpoint, an oval or obround pulley can be easily extruded and finished.

A groove profile on wedges 24*a* and 24*b* of three parallel spaced apart grooves 36 perpendicular to the direction of rope movement (i.e. perpendicular to direction C) was found advantageous. A smooth wedge did not provide enough friction to cause self-locking after fall arrest, even when more compression and torque was applied. Oddly, a smooth wedge was able to stop a falling load, but was unable to hold the load without allowing rope creep post-drop. Applying more rope compression by increasing torque to overcome rope creep yielded erratic peak forces and required stronger and larger, and consequently undesirably heavier wedges and side-plates. The groove profile as depicted also minimized visible rope damage. A more aggressive groove profile resulted in damaged rope sheaths. The grooves are on the wedges instead of on the oval pulley as this applies friction to the outside path. This helps minimize rope chaffing and glazing during fall arrest. Also, grooves placed on the pulley make post-drop release more difficult as some of the rope becomes bunched in the grooves, making it harder to initiate release. Grooves on the pulley are also more likely to fill in with dirt, rope fiber and other foreign matter, thereby affecting fall arrest.

Pulley 14 has a travel limiter member 30 or stop which travels in, and contacts the ends 32*a* and 32*b* of, aperture 32 in side-plate 22 to limit the rotation of pulley 14 in directions D or D'. This results in the specific sized gaps 28*a* and 28*b* between the wedges and pulley 14. Without these gaps, depending on which rope and mass combination are used, greater rope compression occurs, resulting in excessive peak forces. The size of the gap is dictated by a combination of the stop size, the degree of travel allowed by aperture 32 and the size of plate 22. The gap size may be changed by changing any of these components. The gap allows the tension in the rope to build to a target level below 15 kN, and then slippage will commence. This controlled slippage dissipates energy while limiting peak force. Too large a gap results in too much rope slippage and sometimes will not allow for self-locking post-drop.

In alternative embodiments, instead of having one rope brake device that can accept both 11.1 and 12.7 mm rope diameter ranges, the rope diameter ranges have been split into two ranges of 10.0–11.5 mm and 11.5–13.0 mm. Use of two rope diameter ranges in this manner may alleviate uncertainty in use of the rope brake being able to make the fall arrest demands for all rope brands and so that, in the marketplace the availability of devices for both ranges may avoid users thinking it is acceptable to use the smallest diameter rope (for example 10 mm) to handle larger rescue-sized loads (for example 280 kg). Even though the rope brake of the present invention may be able to handle such a combination of small diameter rope and large load size, such a combination may not be wise from an overall static systems safety factor standpoint and applicant wants to discourage use of such a combination merely because the rope diameter fits into the range of rope diameters of which the rope brake of the present invention is capable of physically fitting between the pulley and wedges. However, the use of two distinct rope diameter range versions of the rope brake of the present invention results in different gap specifications between the pulley and the wedges depending on which of the two rope diameter ranges are employed. Thus, in the embodiment employing the larger rope diameter range, the gap size may be in the range of 0.25 inches. In the embodiment employing the smaller rope diameter range, the gap size may be in the range of 0.15 inches. The presentation angle $\alpha$ may be approximately 27.5 degrees, where the presentation angle is defined as the maximum angle that the longitudinal axis B' of pulley 14 makes relative to longitudinal axis B during rotation of pulley 14 about pivot axis A.

A pair of rollers 38 are mounted to side-plate 22. The rollers are mounted one on either end 32*a* and 32*b* of aperture 32. Aperture 32 is necessarily arcuate because of the arc swept out by member 30 as pulley 14 pivots about pivot axis A relative to the side plates. The close adjacency of rollers 38 to the ends of aperture 32 allows the bearing surfaces 40*a* of cam lobe 40 to bear against rollers 38 when pulley 14 is in a fully pivoted position. Release lever 42 pivots in direction G about axis B" through travel limiter member 30. The lever arm or handle of release lever 42 extends in an opposite direction to the oppositely disposed cam lobe 40, oppositely disposed relative to axis B.

When pulley 14 is pivoted so as to compress rope segments 12*a* in gap 28*a* or 28*b*, rotating release lever 42 engages cam lobe 40 against the corresponding roller. Continued rotation of the release lever arm forces the cam lobe over and past the roller thereby forcing the pulley away from the corresponding wedge, opening the gap and releasing the compression of the rope segments.

A tension spring (not shown) keeps release lever 42 in a neutral i.e. centered position so as not to interfere with fall arrest. The only purpose of the release lever is to contact the roller 38 most closely adjacent a lobe 34 on pulley 14 when the pulley is fully rotated and the gap 28*a* or 28*b* is smallest, and to lever the pulley away from the corresponding wedge thereby decompressing and freeing the rope segments 12*a*. The geometry of the release lever allows for greater mechanical advantage initially, and then a lessened mechanical advantage as the pulley beings to move away from the wedge. Also, if for some reason the tension spring fails over time, the release lever design allows the lever to be bumped out of the way during fall arrest so that it does not inadvertently prevent fall arrest i.e. prevent self-locking of pulley 14 so as to clamp the rope. In an alternative embodiment such as seen in FIG. 5, the lobe end of the release lever is elongated to displace the cam lobes further from axis B", again so as to facilitate bumping of the lever out of the way to thereby not inadvertently prevent fall arrest.

The two side-plates 22 and 26 are held together by a push pin 44 and ball lock 46 system located within pivot axle 16. To open device 10, the recessed push pin 44 is depressed. This frees ball locks 46 from engagement with side-plate 26. With push pin 44 depressed, hole 48 in side-plate 26 and wedges 24*a* and 24*b* may be removed from engagement with pivot axle 16 and apertures 50 respectively. A short cord 52 may be provided to hold the ends of side-plates 22 and 26 linked together, in which case device 10 opens in a clam-shell fashion by separating anchor ends 22*a* and 26*b* in opposite directions H and H'. The anchor ends may be anchored by means of a carabiner or snap-link 53 clipped through matching apertures 22*b* and 26*b*.

Axle 16 may be journalled in sleeve 16*a*, sleeve 16*a* supported between washers 16*b*. Rollers 38 are mounted to side-plate 22 by threaded roller mounts 38*a* threaded onto corresponding threaded bolts 38*b*. Rivets may also be used. Member 30 is mounted to pulley 14 by means of bolt 30*a* engaging corresponding threaded hole 30*b* in pulley 14. Bolt 30*a* is journalled through bushing 30*c*. Wedges 24*a* and 24*b* may be mounted to side plate 26 by means of rivets, bolts or screws 54 or the like.

Figure 6:
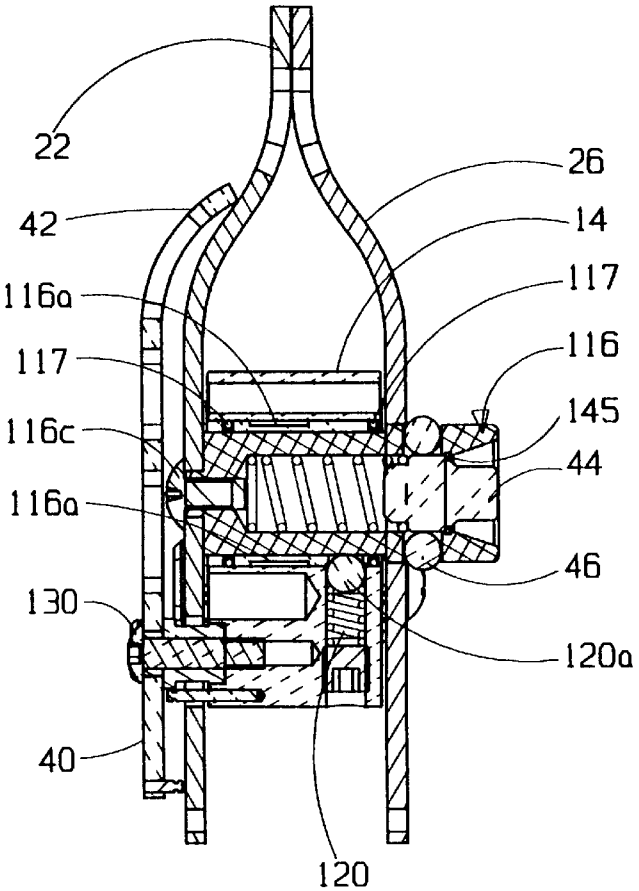
FIG. 6 is a cross-sectional view taken along line 6—6 in FIG. 5.
Figure 5:
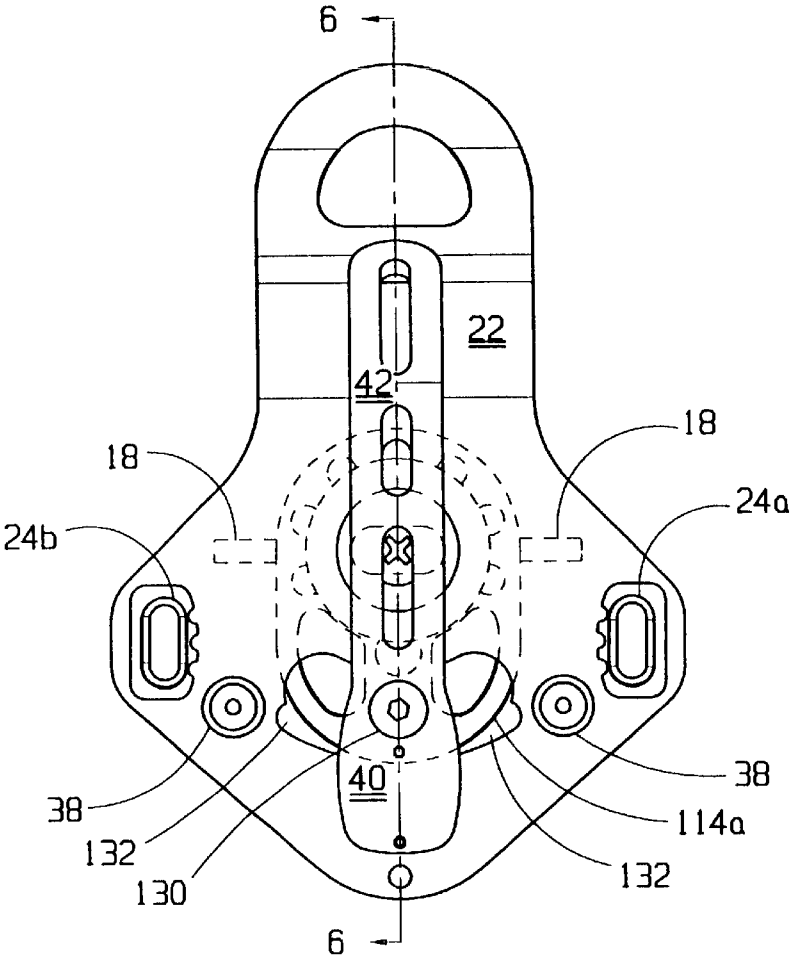
FIG. 5 is, in plan view, an alternative embodiment of the force limiting rope brake of the present invention.

In the alternative embodiment of FIGS. 5 and 6, as mentioned above, the profile of lobe end 40 of the release lever has been elongated. The shape of slot 132 has been changed as compared to corresponding slot 32 in the embodiment of FIG. 1. Similarly, the shape of the aperture where pulley pin 116 corresponding to shaft 16 mounts to plate 22 is obround, pulley pin 116 mounted to plate 22 by means of bolt 116*c*. Member 130 is substituted for the member 30 and bushing 30*c* of the embodiment of FIGS. 1 and 2. Further, the spring mounted ball bearing 20 on surface 14*a* of FIG. 2 which resiliently engaged a corresponding ball detent on plate 22, is replaced with a spring and ball assembly 120 so as to engage the ball with a detent in bushing 116*a*. A set screw (not shown) mounts into pulley 14 so as to maintain spring and ball assembly 120 journalled in a cylindrical cavity in pulley 14 biasing ball 120*a* against bushing 1 16a. A pair of O-rings 117 make a seal between bushing 116*a* and the corresponding cylindrical cavity of pulley 14. Push pin 44 is held within pulley pin 116 by a retaining ring 145 such as a spirally wound flat spring.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims. In particular it is intended that the present invention is not limited only to rescue belay, but may also be used in other applications such as set out above in the Field of the Invention.

TABLE 1

1 m drop of 280 kg onto 3 m of 12.5 mm PMI EZ Bend Rope

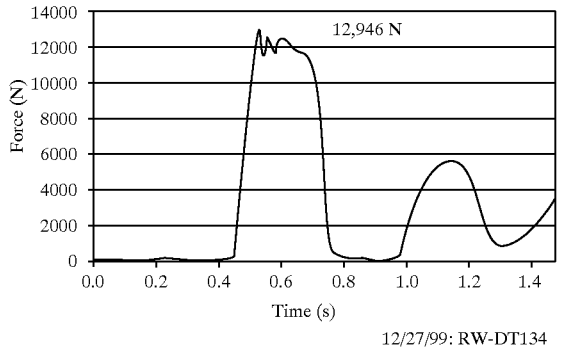

slide distance = 24.0 cm
additional pre-rebound travel = 61.6 cm

TABLE 1

1 m drop of 200 kg onto 3 m of 11.1 mm BW II Rope

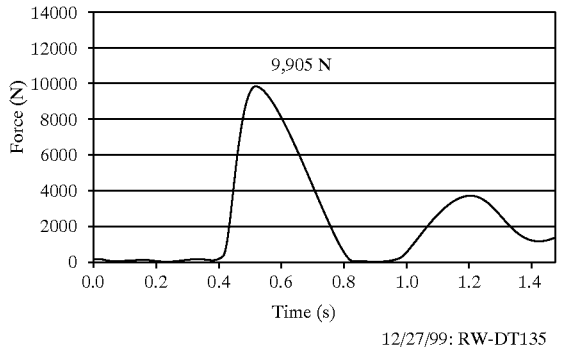

slide distance = 18.0 cm
additional pre-rebound travel = 75.5 cm

What is claimed is:

1. A force limiting rope brake device comprising a pair of rigid first and second side-plates in parallel overlaid array sandwiching therebetween a pivotally mounted pulley, said pulley pivotable about a pivot axis extending orthogonally between parallel first and second planes, said first and second planes substantially containing at least first ends of said first and second side-plates, wherein said pulley is elongate when viewed in cross-section parallel to said first and second planes, said pulley pivotally mounted at a first end of said pulley so that pivoting of said pulley rotates an opposite second end of said pulley in an arc between said side-plates about said pivot axis, wherein said arc sweeps out an arcuate path parallel to said first and second planes and substantially centered relative to said first and second side-plates, wherein said arcuate path is bounded at its ends so as to constrain rotation of said pulley about said pivot axis between fully rotated first and second positions symmetrically and oppositely disposed on opposite sides of a center plane bisecting said first and second side-plates and orthogonal to said first and second planes, a pair of rigid wedges rigidly mounted between said first and second side-plates on opposite lateral sides of said pulley, said first and second wedges and said pulley when in said first or second positions defining there between, respectively, first and second gaps, said first and second gaps sized so that rope segments would be journalled through said first and second gaps and about said pulley, and are further compressed in either said first or second gaps when said pulley is rotated into either corresponding said first or second positions respectively.

2. The device of claim 1 wherein said pulley has a smooth, rope engaging surface and said pulley is sized to receive 1½ wraps of said rope around said rope engaging surface, parallel to said wedges.

3. The device of claim 1 wherein wraps of said rope around said pulley are separated by a wrap-separator.

4. The device of claim 3 wherein said wrap separator comprises oppositely extending pins mounted to said rope engaging surface of said pulley.

5. The device of claim 1 wherein rope engaging surfaces on said wedges have striations striated perpendicularly to the first and second planes.

6. The device of claim 5 wherein said striations are a parallel array of grooves.

7. The device of claim 1 wherein said pulley is obround in cross-section parallel to said first and second planes.

8. The device of claim 1 wherein said arcuate path is bounded at said ends by a rigid follower mounted to said pulley so as to slide in an arcuate aperture in said first side plate, said follower engaging ends of said aperture at said ends of said arcuate path.

9. The device of claim 8 wherein a cam lever is pivotally mounted to said follower so as to dispose a cam on one end of said cam lever on opposite sides of said follower to a handle on said cam lever, said cam for engaging rigid members on said first plate upon rotation of said handle to thereby urge rotation of said pulley about said pivot axis and releasing said rope when clamped between one of said wedges and said pulley.

10. A force limiting rope brake device comprising a pivotally mounted elongate pulley mounted to a base, said pulley pivotable about a pivot axis extending orthogonally from said base, said pulley pivotally mounted at a first end of said pulley so that pivoting of said pulley rotates an opposite second end of said pulley in an arc about said pivot axis, wherein said arc sweeps out an arcuate path generally parallel to said base, wherein said arcuate path is bounded at its ends by stops so as to constrain rotation of said pulley about said pivot axis between fully rotated first and second positions symmetrically and oppositely disposed on opposite sides of a center plane bisecting said arc and orthogonal to said base, a pair of rigid wedges rigidly mounted to said base on opposite lateral sides of said pulley, said first and second wedges and said pulley when in said first or second position defining there between, respectively, first and second gaps, said first and second gaps sized so that rope segments would be journalled through said first and second gaps and about said pulley, and are further compressed in either said first or second gaps when said pulley is rotated into either corresponding said first or second position respectively.

11. The device of claim 10 wherein said pulley has a smooth, rope engaging surface and said pulley is sized to receive 1½ wraps of said rope around said rope engaging surface, parallel to said wedges.

12. The device of claim 10 wherein wraps of said rope around said pulley are separated by a wrap-separator.

13. The device of claim 12 wherein said wrap separator comprises oppositely extending pins mounted to said rope engaging surface of said pulley.

14. The device of claim 10 wherein rope engaging surfaces on said wedges have striations striated perpendicularly to the first and second planes.

15. The device of claim 14 wherein said striations are a parallel array of grooves.

16. The device of claim 10 wherein said pulley is obround in cross-section parallel to said first and second planes.

17. The device of claim 10 wherein said base has an arcuate aperture therein and a rigid follower is mounted to said pulley so as to slide in said arcuate aperture in said base, ends of said aperture at said ends of said arcuate path forming said stops.

18. The device of claim 17 wherein a cam lever is pivotally mounted to said follower so as to dispose a cam on one end of said cam lever on opposite sides of said follower to a handle on said cam lever, said cam for engaging rigid members on said base upon rotation of said handle to thereby urge rotation of said pulley about said pivot axis and releasing said rope when clamped between one of said wedges and said pulley.

19. The device of claim 10 further comprising a retainer mounted to said pulley, opposite to said base so as to retain on said pulley a rope wound onto said pulley during translation of said rope through said pulley.

20. The device of claim 19 wherein said base is a first plate, and wherein said retainer is a second plate, and said first and second plates are generally parallel and said pulley is pivotally mounted sandwiched therebetween.

* * * * *